US010030550B2

(12) United States Patent
Yano et al.

(10) Patent No.: US 10,030,550 B2
(45) Date of Patent: Jul. 24, 2018

(54) VALVE DEVICE FOR INTERNAL COMBUSTION ENGINE

(71) Applicant: TOYOTA JIDOSHA KABUSHIKI KAISHA, Toyota-shi (JP)

(72) Inventors: Toshiyuki Yano, Nagakute (JP); Yuu Yokoyama, Okazaki (JP); Toru Sakuma, Nissin (JP); Yuta Nishimura, Toyota (JP); Atsuhisa Tamano, Anjo (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 115 days.

(21) Appl. No.: 15/365,343

(22) Filed: Nov. 30, 2016

(65) Prior Publication Data

US 2017/0152771 A1 Jun. 1, 2017

(30) Foreign Application Priority Data

Dec. 1, 2015 (JP) ..... 2015-234868

(51) Int. Cl.

| | |
|---|---|
| ***F01L 1/34*** | (2006.01) |
| ***F01L 13/00*** | (2006.01) |
| *F01L 1/18* | (2006.01) |
| *F01L 1/24* | (2006.01) |
| *F01L 1/053* | (2006.01) |
| *F01L 1/344* | (2006.01) |

(52) U.S. Cl.

CPC ..... *F01L 13/0036* (2013.01); *F01L 13/0015* (2013.01); *F01L 13/0063* (2013.01); *F01L 1/185* (2013.01); *F01L 1/2405* (2013.01); *F01L 2001/0537* (2013.01); *F01L 2001/34496* (2013.01); *F01L 2013/0052* (2013.01); *F01L 2013/101* (2013.01); *F01L 2105/00* (2013.01); *F01L 2800/06* (2013.01)

(58) Field of Classification Search

CPC ..... F01L 13/0036; F01L 13/0063; F01L 13/0015; F01L 2013/0052; F01L 2013/101; F01L 1/185; F01L 1/2425; F01L 2001/0537; F01L 2001/34496; F01L 2105/00; F01L 2800/06

See application file for complete search history.

(56) References Cited

U.S. PATENT DOCUMENTS

| | | | | |
|---|---|---|---|---|
| 6,591,798 | B2 | 7/2003 | Hendriksma et al. | |
| 2010/0071644 | A1* | 3/2010 | Noda ..... | F01L 13/0015 123/90.16 |

FOREIGN PATENT DOCUMENTS

| | | | |
|---|---|---|---|
| JP | 2009-052419 | A | 3/2009 |
| JP | 2010-520395 | A | 6/2010 |

* cited by examiner

*Primary Examiner* — Zelalem Eshete

(74) *Attorney, Agent, or Firm* — Oblon, McClelland, Maier & Neustadt, L.L.P.

(57) ABSTRACT

A first swing arm of each cylinder is swung by a fixed cam of an intake camshaft, so as to operate a first intake valve according to a profile thereof. A second swing arm is swung by a second cam and its swing range is changed by a variable mechanism. Hereby, a lift amount of a second intake valve changes continuously. The second cam is selected from a plurality of cams on a cam piece provided around the intake camshaft.

5 Claims, 8 Drawing Sheets

VALVE DEVICE FOR INTERNAL COMBUSTION ENGINE

INCORPORATION BY REFERENCE

The disclosure of Japanese Patent Application No. 2015-234868 filed on Dec. 1, 2015 including the specification, drawings and abstract is incorporated herein by reference in its entirety.

BACKGROUND

1. Technical Field

The present disclosure relates to a valve device that operates an intake valve of an internal combustion engine.

2. Description of Related Art

As a valve device of an internal combustion engine (hereinafter also referred to as an engine), there have been known Variable Valve Timing (VVT) that changes a valve timing and Valve Variable Lift (VVL) that changes a valve lift amount. Japanese Patent Application Publication No. 2009-052419 (JP 2009-052419 A) describes a valve device including: a swing arm that swings along with a rotation of the camshaft so as to operate an intake valve; and a variable lift mechanism that continuously changes a lift amount of the intake valve by changing a swing range of the swing arm.

Published Japanese Translation of PCT application No. 2010-520395 (JP-A-2010-520395) describes a cam-switch-type variable mechanism configured such that a cam carrier (a cam piece) including a plurality of cams is provided around a camshaft, and a cam is selected by sliding the cam carrier in an axial direction of the camshaft. In the variable mechanism, a spiral guide groove is provided on an outer periphery of the cam carrier, and a shift pin is externally engaged with the guide groove, so as to slide, in a cam axial direction, the cam carrier rotating integrally with the camshaft.

SUMMARY

In the meantime, in recent years, in order to improve thermal efficiency of a gasoline engine, there has been an attempt to put, to practical use, combustion different from combustion by normal spark ignition, e.g., combustion by Homogeneous Charge Compression Ignition (HCCI). It may be difficult to realize such combustion in all operating states of loads and rotation numbers requested to an engine of a vehicle. On this account, it has been proposed to switch between the normal combustion and the HCCI combustion, that is, to switch an operating state of the engine between a normal operation mode and an operation mode different from the normal operation mode.

However, in the variable lift mechanism that changes the swing range of the arm, it is possible to continuously change the lift amount of the intake valve, but a lift curve at this time basically follows a profile of the cam. Accordingly, it is difficult to largely change general lift characteristics including a working angle. Because of this, it is difficult to realize the change of the lift characteristics of the intake valve, requested to the aforementioned switching of the operation mode.

In view of this, it is conceivable to largely change the lift characteristics of the intake valve by combining the variable mechanism configured to change the swing range of the arm, with the cam-switch-type variable mechanism. However, if such two types of mechanisms are combined, a structure is complicated, which may cause a concern about failures.

Further, the variable lift mechanism is configured to operate while receiving a reaction force of a valve spring from the intake valve, which easily causes delay of the operation. Thus, it may be difficult to obtain a high response requested to a control on the HCCI combustion.

The present disclosure provides a technique related to a valve device including a variable mechanism that is able to continuously change a lift amount of an intake valve, and the technique is to perform a fail-safe to a failure by raising a response of a control on a lift amount of lift while enabling switching between a normal operation mode and an operation mode different from the normal operation mode.

In the present disclosure, one of two intake valves provided for each cylinder in an engine has a simple configuration in which its lift characteristic does not change, while a second intake valve is configured such that its lift characteristic is largely changeable in combination with a variable lift mechanism and a cam switch mechanism.

An aspect of the present disclosure provides a valve device for an internal combustion engine. The valve device includes two intake valves, a camshaft, a first swing arm, a second swing arm, a cam piece, a first cam, second cams and a variable mechanism. The two intake valves are provided for each cylinder of the internal combustion engine. The two intake valves include a first intake valve and a second intake valve. The first swing arm is configured to swing along with a rotation of the camshaft. The first swing arm is configured to operate the first intake valve. The second swing arm is configured to swing along with the rotation of the camshaft. The second swing arm is configured to operate the second intake valve. The cam piece is provided around the camshaft. The first cam is fixed to the camshaft. The first cam is configured to swing the first swing arm such that the first intake valve is operated according to a profile of the first cam. The second cams are provided on the camshaft. The second cams are configured to swing the second swing arm. The second cams include a plurality of cams having different profiles. The plurality of cams is provided on the cam piece so as to be arranged in an axial direction of the camshaft. One of the plurality of cams is configured to be selected by sliding the cam piece. The variable mechanism is configured to change a swing range of the second swing arm such that a lift amount of the second intake valve changes continuously.

According to the above configuration, the first swing arm of each cylinder is swung by the first cam along with the rotation of the camshaft during an operation of the engine. Hereby, the first intake valve is operated according to the profile of the first cam. Further, the second swing arm is swung by the second cam and its swing range is changed by the variable mechanism. This makes it possible to continuously change the lift amount of the second intake valve.

Thus, the variable mechanism configured to change the swing range of the swing arm operates while receiving a reaction force of a valve spring from the second intake valve. Meanwhile, the variable mechanism does not receive a reaction force from the first intake valve. Accordingly, a mechanical frictional resistance becomes small, so that delay of the operation decreases. This improves a response of a control on the lift amount of the second intake valve by the operation of the variable mechanism, thereby making it possible to obtain a high response requested to a control on HCCI combustion, for example.

Further, a plurality of second cams is provided on the cam piece provided around the camshaft, and by selecting either one of them, it is possible to largely change general lift characteristics including a working angle. Accordingly, it is possible to switch between a normal operation mode of the engine and an operation mode different from the normal operation mode. In addition, as described above, no variable mechanism for a lift amount and no switching device are provided for the first intake valve. Accordingly, even if either of the mechanisms is broken, that does not affect the operation of the first intake valve, and thus, a fail-safe is achieved.

In the valve device, the second cams may include a general cam and a low lift cam. The general cam may have the profile as the first cam. The low lift cam may have a lift amount smaller than a lift amount of the general cam. According to the above configuration, the general cam has the same profile as the first cam, which is advantageous to raise intake-air charging efficiency in an operating state with a high load ratio. Further, in an operating state of a low load or the like in which a flow rate of the intake air is decreased, a flow speed of the intake air is increased by decreasing, by the variable mechanism, the lift amount of the second intake valve driven by the general cam, thereby making it possible to enhance a swirl flow in the cylinder and to improve combustibility.

In the meantime, when the low lift cam is selected to establish the operation mode different from the normal operation mode, a reaction force from the intake valve becomes smaller than the general cam, so that the delay of the operation of the variable mechanism due to a mechanical frictional resistance further decreases. This further improves a response of a control on the lift amount of the second intake valve in the operation mode different from the normal operation mode, thereby making it possible to attain a high responsive control suitable for the HCCI combustion, for example.

In the valve device, the low lift cam may be configured such that the second intake valve is opened in an exhaust stroke of the cylinder. According to the above configuration, in a case where the HCCI combustion is performed in the operation mode different from the normal operation mode, the second intake valve is opened in the exhaust stroke. Accordingly, after exhaust gas in the cylinder is partially exhausted to an intake port once, the exhaust gas flows into the cylinder again in a next intake stroke. That is, by blowing and returning part of the exhaust gas to an intake system, so-called internal EGR is performed.

Then, the swing range of the second swing arm pressed by the low lift cam is changed by the variable mechanism, so that the lift amount of the second intake valve changes continuously. Hereby, an amount of internal EGR gas, that is, a ratio of the exhaust gas included in the intake air can be adjusted with accuracy, so that accuracy of a control on a temperature in the cylinder by the high-temperature internal EGR gas improves, thereby making it possible to cause self-ignition of fuel/air mixture at a preferable timing. That is, in order to perform the HCCI combustion, it is possible to control the temperature in the cylinder with high accuracy.

In the valve device, a dimension of the low lift cam in the axial direction of the camshaft may be smaller than a dimension of the general cam. As described above, when the low lift cam is selected, a reaction force of the valve spring from the intake valve becomes small. According to the above configuration, by decreasing a sliding contact area between the low lift cam and the second swing arm, it is possible to further decrease the mechanical frictional resistance. Hereby, the delay of the operation of the variable mechanism is further decreased, thereby making it possible to further increase the response of the control on the lift amount of the intake valve.

In the valve device, the variable mechanism may be provided adjacently to the first swing arm. The variable mechanism may be configured to swing around a spindle of the variable mechanism. The variable mechanism may include an input arm, a movable connecting member and an adjustment member. The second cams may be configured to press the input arm. The movable connecting member may be configured to connect the input arm to the second swing arm such that a relative angle between the input arm (51) and the second swing arm is changed. The adjustment member may be configured to operate the movable connecting member so as to adjust the relative angle between the input arm and the second swing arm.

According to the valve device, in the valve device including the variable mechanism that can continuously change a valve lift amount, one of two intake valves provided for each cylinder has a simple configuration in which its lift characteristic does not change, and the second intake valve is configured such that its lift characteristic is largely changeable in combination with the variable mechanism and the cam switch mechanism. This makes it possible to switch between the normal operation mode and the operation mode different from the normal operation mode and to increase the response of the control on the lift amount. Besides, a fail-safe to a failure is also achievable.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
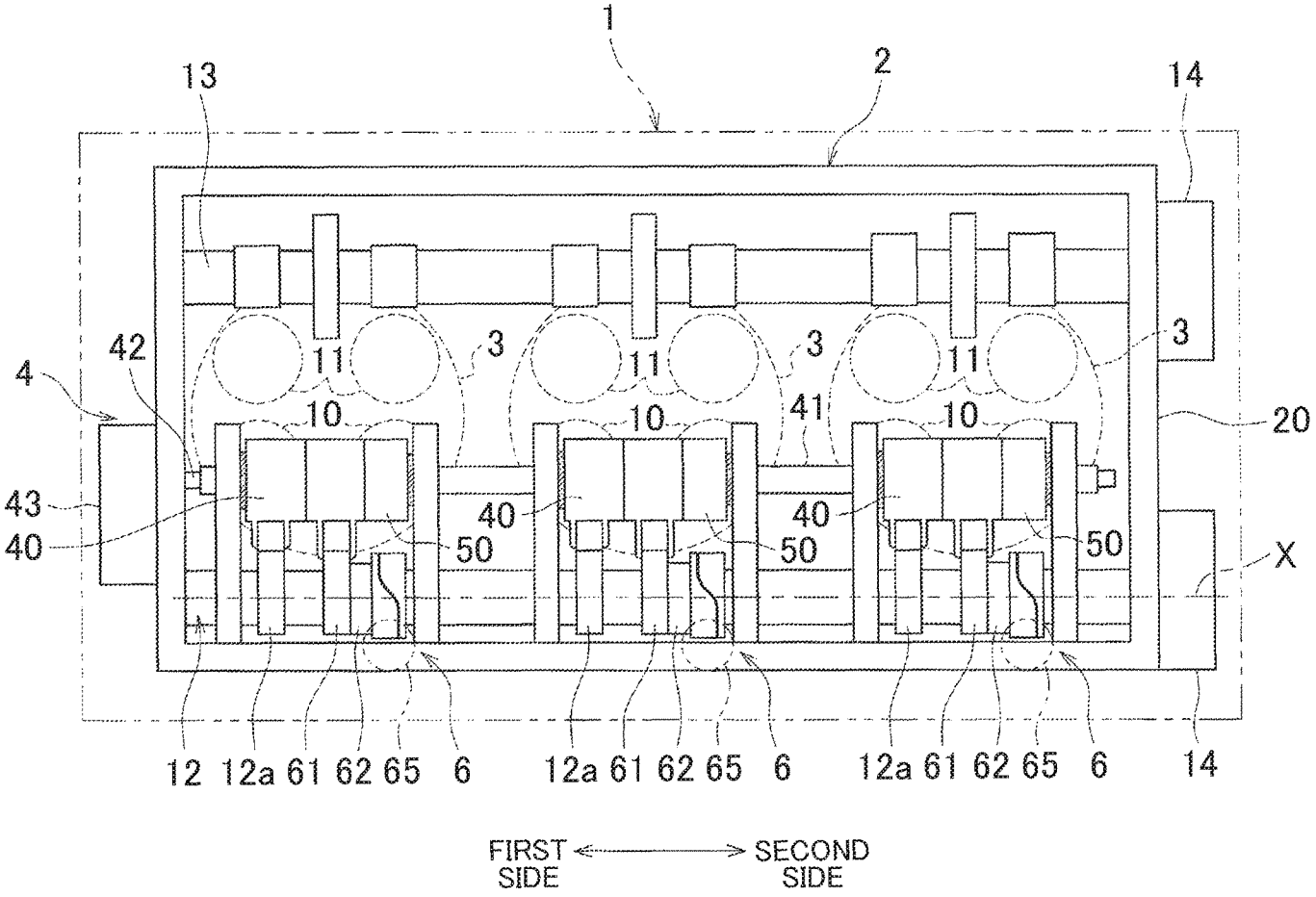
FIG. 1 is a schematic configuration diagram of a valve device for an engine according to an embodiment.

The following will describe an embodiment with reference to the drawings. As schematically illustrated from above in FIG. 1, a cam housing 2 is disposed on an upper part (a cylinder head) of an engine 1, so as to accommodate an exhaust/intake valve system (a valve device) therein. The engine 1 is a gasoline engine and is one example of an internal combustion engine. That is, as indicated by a broken line in FIG. 1, three cylinders 3 arranged in line are each provided with two intake valves 10 and two exhaust valves 11, which are driven by an intake camshaft 12 and an exhaust camshaft 13, respectively.

Further, respective ends (right ends in FIG. 1) of the intake camshaft 12 and the exhaust camshaft 13 are provided with respective Variable Valve Timings (VVT) 14 that continuously change valve timings. The intake camshaft 12 includes a variable lift mechanism 4 that can continuously change a lift amount (a maximum lift amount) of the intake valve 10, and a cam switch mechanism 6 that switches between cams 61, 62 for driving the intake valve 10. The variable lift mechanism 4 and the cam switch mechanism 6 are provided for each of the cylinders 3.

More specifically, first, a fixed cam driver (a first cam) 12*a* is provided in the intake camshaft 12 for an intake valve 10 (a first intake valve) on a first side (a left side in FIG. 1) in a direction (a cam axial direction) of an axis X of the intake camshaft 12 out of two intake valves 10 in the cylinder 3. Along with a rotation of the intake camshaft 12 as indicated by an arrow R in FIG. 2, the fixed cam 12*a* swings a swing arm (a first swing arm) 40 so as to operate the intake valve 10 on the first side via a rocker arm 15 (see FIG. 3).

Figure 2:
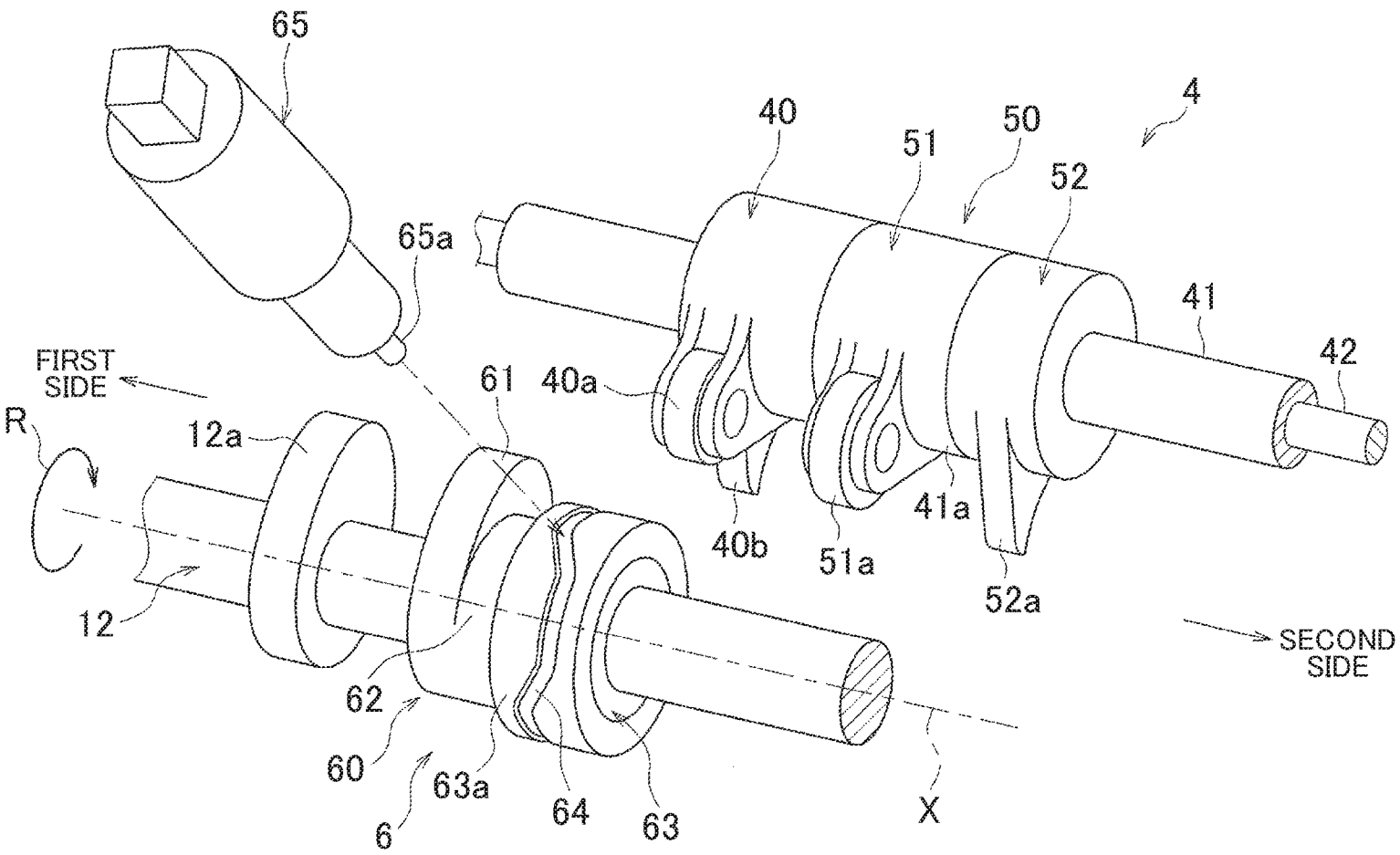
FIG. 2 is a perspective view illustrating a variable lift mechanism and a cam switch mechanism with a space therebetween.

That is, as illustrated in FIG. 2, the swing arm 40 includes a roller 40*a* with which the fixed cam 12*a* makes sliding contact, and a nose 40*b* that presses the rocker arm 15, and the swing arm 40 is swingably provided around a rocker shaft 41. When the roller 40*a* is pressed by the rotating fixed cam 12*a,* the swing arm 40 swings around the rocker shaft 41, so as to operate the intake valve 10 on the first side according to a profile of the fixed cam 12*a*.

On the other hand, an intake valve 10 (a second intake valve) on a second side (a right side in FIG. 1) in the axis-X direction in the cylinder 3 is operated by either of two cams (second cams) 61, 62 arranged in line in the axis-X direction on the intake camshaft 12. That is, as will be described later, either one of the cams 61, 62 is selected by the cam switch mechanism 6 and swings an output arm (a second swing arm) 52 of an arm assembly 50 so as to operate the intake valve 10 on the second side via a rocker arm 15 as will be described later with reference to FIG. 3.

Figure 3:
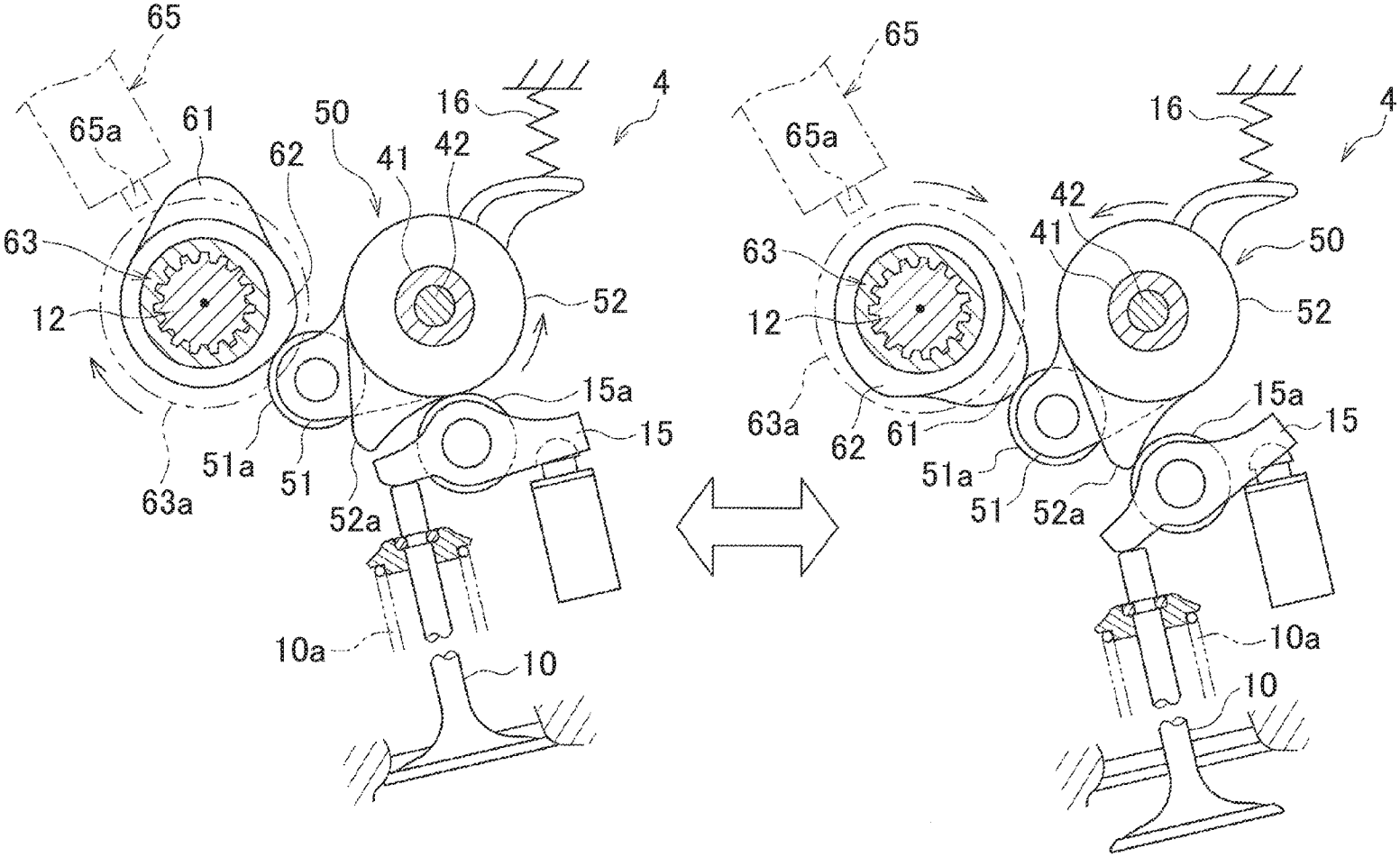
FIG. 3 is a sectional view of the valve device on an intake side and illustrates a state of a maximum lift amount.
Figure 4:
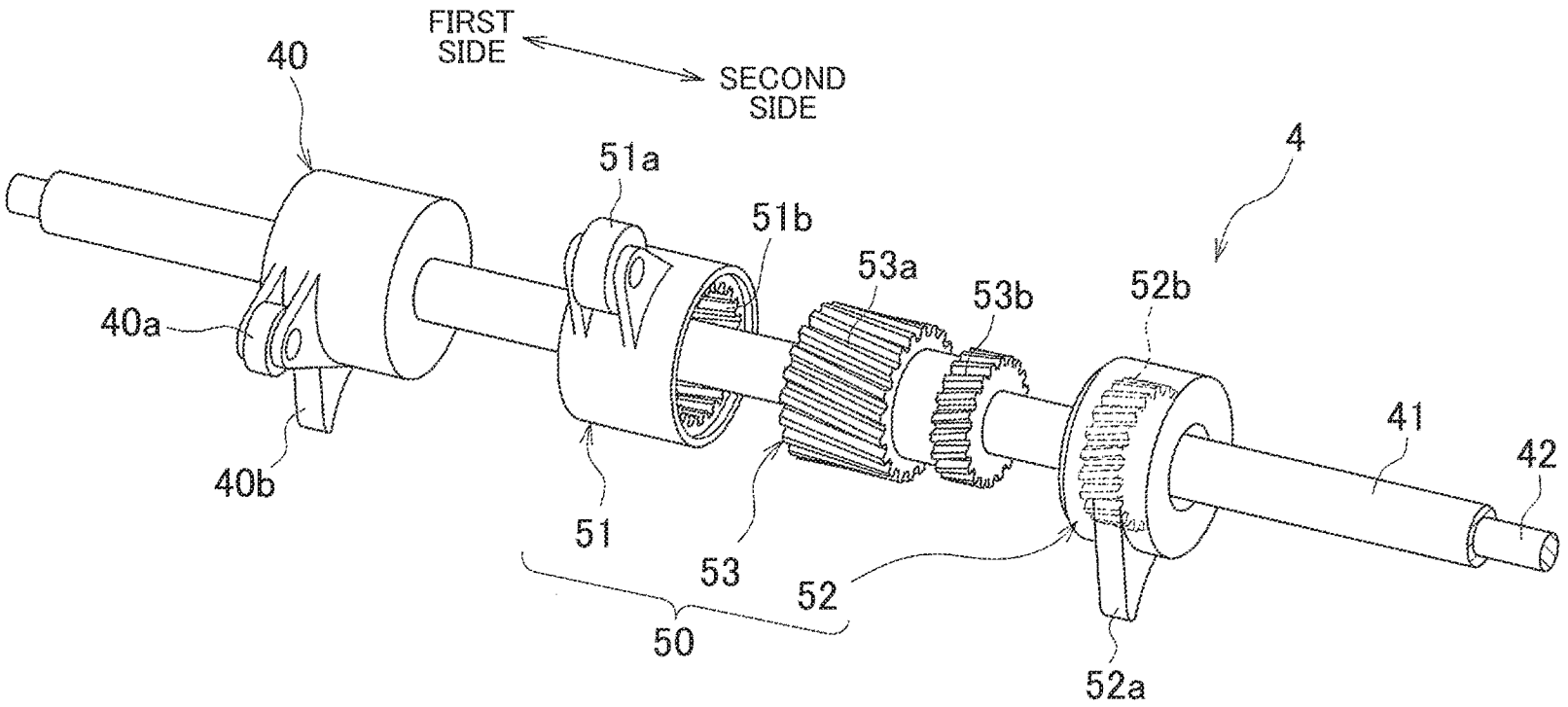
FIG. 4 is an exploded perspective view of an arm assembly of the variable lift mechanism.
Figure 5:
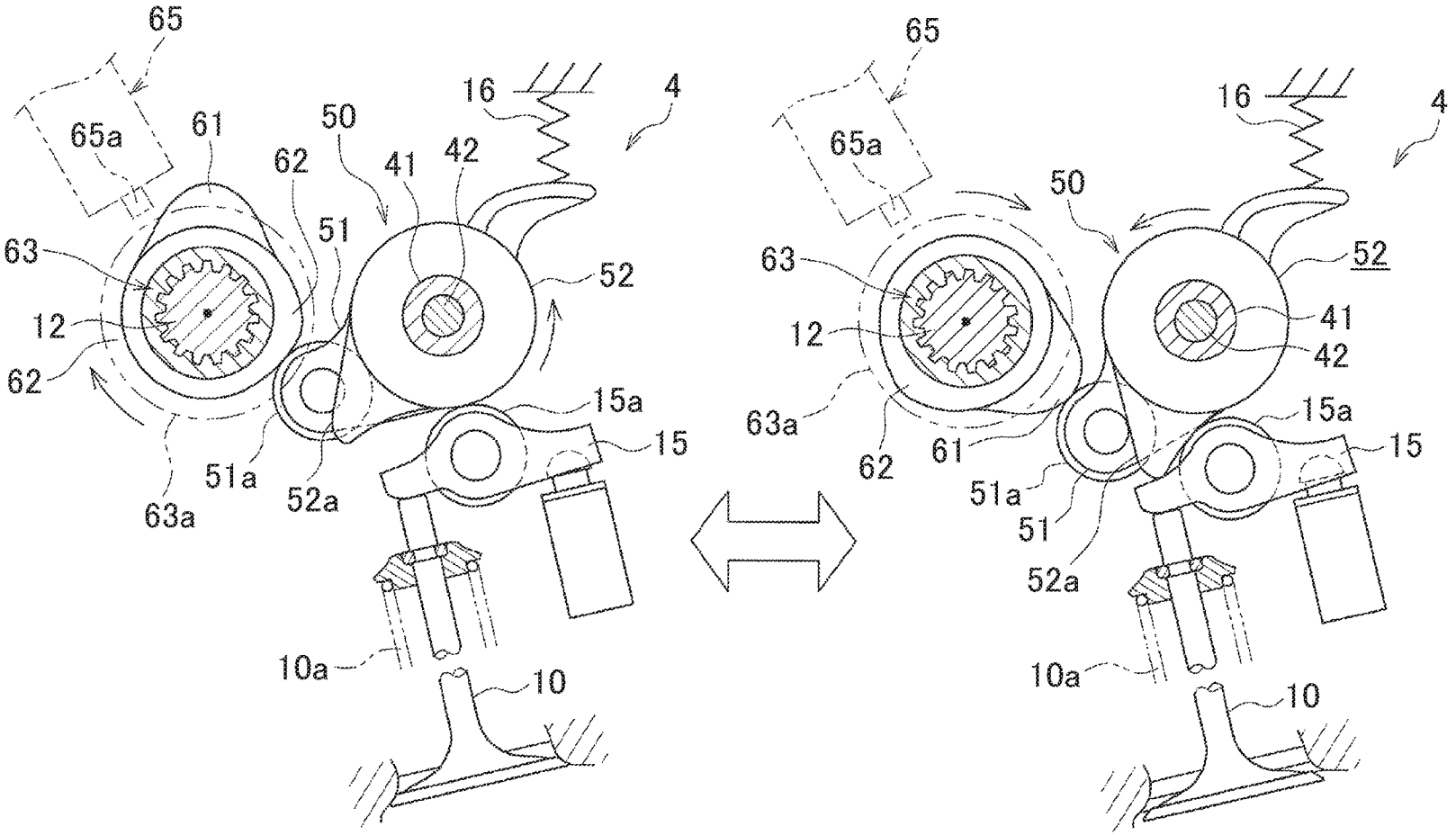
FIG. 5 is a view corresponding to FIG. 3 and illustrates a state of a minimum lift amount.

In the present embodiment, as described above, a swing range of the output arm 52 that swings and operates the intake valve 10 on the second side in the cylinder 3 is changed by the variable lift mechanism 4. A lift amount of the intake valve 10 on the second side hereby changes continuously. As illustrated in FIGS. 3 to 5 other than FIG. 2, the variable lift mechanism 4 includes the rocker shaft 41, a control shaft 42, and an arm assembly 50 provided for each cylinder 3.

The rocker shaft 41 is constituted by a hollow pipe and extends in parallel with the intake camshaft 12, that is, in the axis-X direction. The rocker shaft 41 functions as a swing spindle for the swing arm 40, the output arm 52, and the like. Further, the control shaft 42 is inserted into a central hole of the rocker shaft 41 and is driven by an actuator 43 (illustrated only in FIG. 1). The arm assembly 50 is provided for each cylinder 3 so as to be placed around the rocker shaft 41, and is a variable mechanism operated by the control shaft 42 so as to continuously change the lift amount of the intake valve 10.

That is, as illustrated in FIG. 3, when viewed in the axis-X direction, the arm assembly 50 is swingably provided around the rocker shaft 41 so as to be disposed between the cams 61, 62 of the intake camshaft 12 and the rocker arm 15. The arm assembly 50 includes a roller 51*a* with which either of the cams 61, 62 makes sliding contact, and a nose 52*a* that presses the rocker arm 15. When the roller 51*a* is pressed by either of the cams 61, 62, the arm assembly 50 swings around the rocker shaft 41 so as to operate the intake valve 10 via the rocker arm 15.

More specifically, as illustrated in FIG. 4 in an exploded manner, the arm assembly 50 includes an input arm 51 provided with the roller 51*a,* and an output arm 52 having the nose 52*a*. The input arm 51 and the output arm 52 are provided around the rocker shaft 41 so as to cover a slider gear 53 from its outer peripheral side in a state where the input arm 51 and the output arm 52 are adjacently arranged in line in the axis-X direction. The slider gear 53 is a movable connecting member that connects the input arm 51 to the output arm 52 such that a relative angle therebetween is changeable.

That is, the slider gear 53 has a cylindrical shape and is slidably provided around the rocker shaft 41, and helical splines 53*a,* 53*b* are formed on outer peripheral ends of the slider gear 53 on a first side and a second side (a left side and a right side in FIG. 4) in the axis-X direction. The helical splines 53*a,* 53*b* respectively mesh with helical splines 51*b,* 52*b* formed on inner sides of the input arm 51 and the output arm 52, so as to connect the input arm 51 and the output arm 52.

Further, as illustrated in FIG. 3, the roller 51*a* of the input arm 51 is pressed against the cam 61, 62 (the cam 61 in FIG. 3) by a lost motion spring 16. In the meantime, the roller 15*a* of the rocker arm 15 is pressed against a part of the output arm 52 from its base circle to the nose 52*a*. Hereby, when the input arm 51 swings along with a rotation of the intake camshaft 12, the rocker arm 15 is operated by the output arm 52 swinging integrally therewith, so that the intake valve 10 is lifted.

When the control shaft 42 is displaced in the axis-X direction, the slider gear 53 is displaced on the rocker shaft 41 in the axis-X direction in conjunction with this, so as to cause the input arm 51 and the output arm 52 to pivot in reverse directions to each other. The slider gear 53 is configured to be displaced in the axis-X direction integrally with the control shaft 42 by a pin (not shown) that penetrates through an elongated hole formed in the rocker shaft 41. This displacement is converted into circumferential displacements of the input arm 51 and the output arm 52 by meshing between the helical splines 53*a,* 53*b* and the helical splines 51*b,* 52*b*.

That is, the control shaft 42 is an adjustment member that operates the slider gear 53 so as to adjust a relative angle between the input arm 51 and the output arm 52, and the displacement thereof in the axis-X direction is converted into circumferential displacements of the input arm 51 and the output arm 52 by the slider gear 53 in the arm assembly 50. Hereby, the relative angle between the input arm 51 and the output arm 52 changes, so that the lift amount of the intake valve 10 changes continuously as described below.

For example, in a state where the control shaft 42 moves to the maximum toward the second side (the right side in FIGS. 1, 2 and 4) in the axis X-direction, an angle (a relative phase difference) between the roller 51*a* of the input arm 51 and the nose 52*a* of the output arm 52 as illustrated in FIG. 3 becomes maximum. Hereby, as illustrated on the right side in FIG. 3, in a state where the roller 51*a* of the input arm 51 is pushed down by the cam 61, a displacement amount of the rocker arm 15 becomes its maximum, so that the intake valve 10 operates at its maximum lift amount.

When the control shaft 42 moves toward the first side (the left side in FIGS. 1, 2 and 4) in the axis X-direction from this state, the angle between the roller 51*a* of the input arm 51 and the nose 52*a* of the output arm 52 gradually decreases. When the angle reaches its minimum as illustrated in FIG. 5, the displacement amount of the rocker arm 15 becomes small even in a state where the roller 51*a* of the input arm 51 is pushed down by the cam 61 as illustrated on the right side in the figure, so that the intake valve 10 operates at a minimum lift amount.

In the present embodiment, the cams 61, 62 for driving the intake valve 10 via the variable lift mechanism 4 are switched by the cam switch mechanism 6, as described above. That is, as illustrated in FIGS. 2, 4, a cylindrical cam piece 60 including two cams 61, 62 having different profiles is provided around the intake camshaft 12 so as to be adjacent to the second side (the right side in FIGS. 2 and 4) of the fixed cam 12*a* in the axis-X direction. The fixed cam 12*a* is provided for each cylinder 3.

In an example illustrated herein, the cam 61 on the left side (the first side in the axis-X direction) out of the two cams 61, 62 has the same profile as the fixed cam 12*a* (hereinafter, the cam 61 is referred to as the general cam 61), and the cam 62 on the right side (the second side in the axis-X direction) is a low lift cam 62 having a smaller lift amount than the general cam 61. The low lift cam 62 is provided so as to open the intake valve 10 not in an intake stroke of the cylinder 3, but in an exhaust stroke thereof.

As one example, a lift amount of the intake valve 10 by the low lift cam 62 is not more than half of a lift amount thereof by the general cam 61, and a reaction force from a valve spring 10*a* becomes smaller by just that much, so that a mechanical frictional resistance becomes small. Further, in the present embodiment, a width (a dimension in the axis-X direction) of the low lift cam 62 is also smaller than that of the general cam 61, thereby also decreasing the mechanical frictional resistance. Note that base circles of the general cam 61 and the low lift cam 62 have the same diameter, and are formed as arc surfaces continuous with each other.

Figure 6:
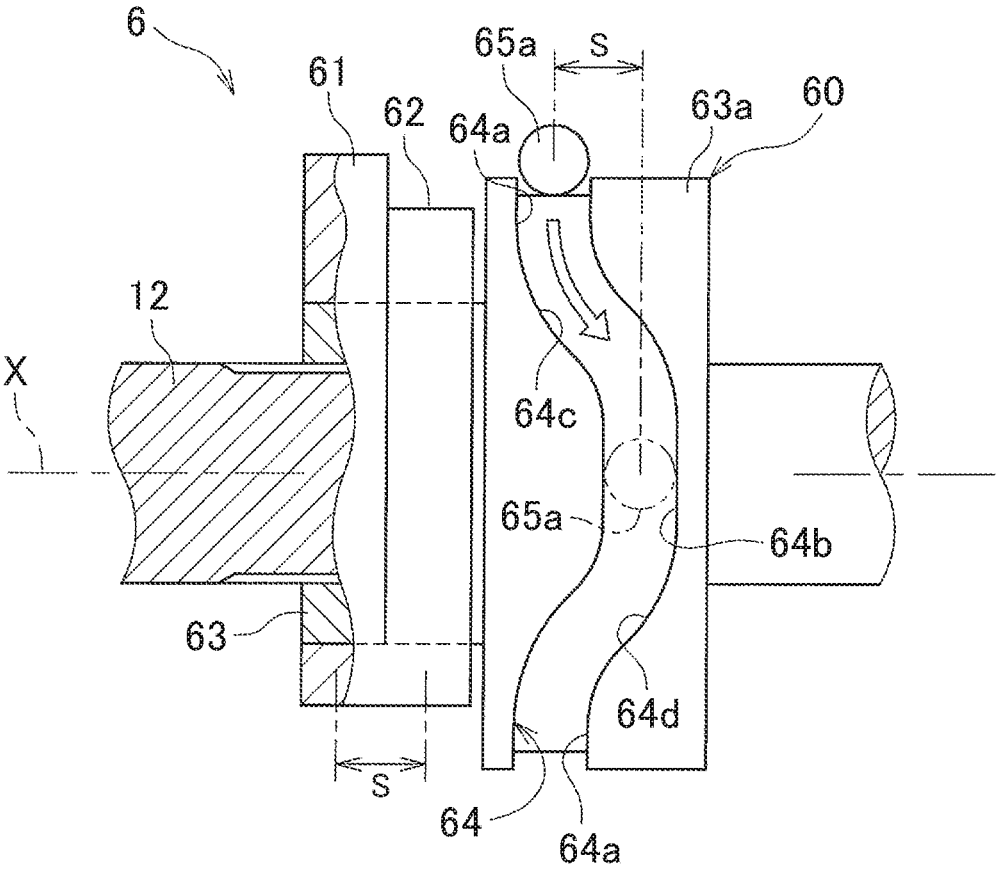
FIG. 6 is a partial sectional view illustrating a structure of a cam piece provided around an intake camshaft.

As illustrated in FIG. 6, the two cams 61, 62 are formed integrally in a ring shape, and are fitted to an end of a cylindrical sleeve 63, so as to constitute the cam piece 60. As illustrated in FIGS. 3, internal teeth of a spline are formed on an inner periphery of the cam piece 60 (the sleeve 63) mesh with external teeth of a spline formed on an outer periphery of the intake camshaft 12. Hereby, the cam piece 60 is provided around the intake camshaft 12 so as to rotate integrally with the intake camshaft 12 and also slide thereon in the axis-X direction.

Further, in order to slide the cam piece 60, a guide groove 64 to be engaged with a shift pin 65*a* is provided on an outer peripheral surface of the cam piece 60, as described below. That is, in the present embodiment, an annular large-diameter portion 63*a* is formed in the other end of the sleeve 63 in the axis-X direction, and the guide groove 64 extending in a circumferential direction over a whole circumference is provided on an outer periphery of the large-diameter portion 63*a*. The large-diameter portion 63*a* has an outside diameter smaller than that of the general cam 61, but larger than that of the low lift cam 62.

In the meantime, as illustrated in FIGS. 2, 3, an actuator 65 configured to drive the shift pin 65*a* in a reciprocating manner is provided for each cylinder 3 so as to be disposed on a diagonally upper side relative to the intake camshaft 12. The actuator 65 is supported by the cam housing 2 via a stay (not shown) extending in the axis-X direction, for example. This actuator 65 drives the shift pin 65*a* by an electromagnetic solenoid, for example, and in an ON state, the shift pin 65*a* moves forward so as to be engaged with the guide groove 64.

When the shift pin 65*a* moves forward so as to be engaged with the guide groove 64, the shift pin 65*a* relatively moves on the outer peripheral surface of the cam piece 60 in the circumferential direction along with a rotation of the intake camshaft 12, and also moves in the axis-X direction, namely, moves diagonally as indicated by an arrow in FIG. 6. This will be described below with reference to FIG. 7. At this time, the cam piece 60 actually rotates and slides relative to the shift pin 65*a* in the axis-X direction.

In the following description, a left side and a right side (the first side and the second side in the axis-X direction) in FIGS. 6, 7 shall be just referred to as the left side and the right side for purposes of this description. First, as illustrated in FIG. 6, the guide groove 64 is constituted by: straight grooves 64*a*, 64*b* that linearly extend in the circumferential direction in a part close to the left side and a part closer to the right part on an outer peripheral surface of the large-diameter portion 63*a* of the sleeve 63; and S-shaped curved grooves 64*c*, 64*d* that connect the straight grooves 64*a*, 64*b* to each other.

As described above with reference to FIG. 3 and the like, when the intake valve 10 is opened by the general cam 61 in the intake stroke via the arm assembly 50 and the rocker arm 15, that is, when the cam piece 60 is placed at a right normal position, the left straight groove 64*a* is opposed to the shift pin 65*a* of the actuator 65 as illustrated in FIG. 6. When the actuator 65 is turned on to move the shift pin 65*a* forward in this state, the shift pin 65*a* is engaged with the left straight groove 64*a* of the guide groove 64, as illustrated on an upper side in FIG. 7.

Figure 7:
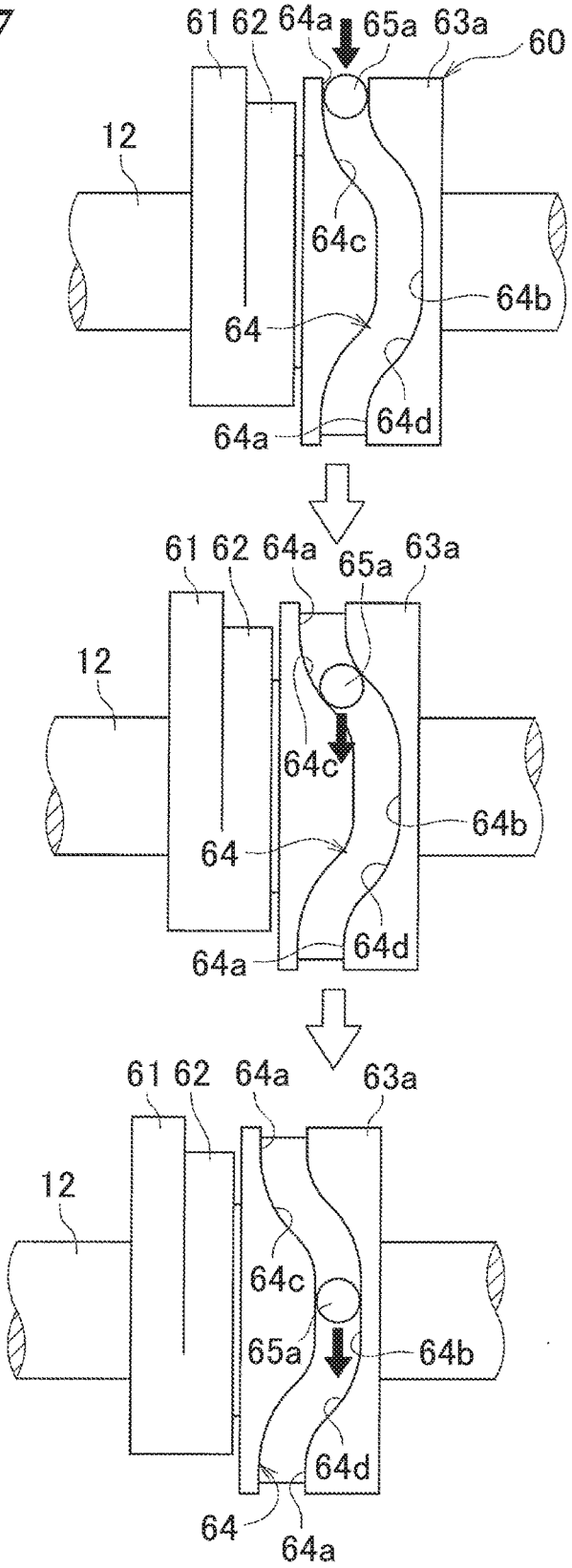
FIG. 7 is a view to describe an operation of the cam switch mechanism that slides the cam piece by engagement between a shift pin and a guide groove.

The shift pin 65*a* thus engaged with the straight groove 64*a* moves downward in FIG. 2 and reaches the curved groove 64C along with rotations of the intake camshaft 12 and the cam piece 60 as indicated by an arrow R in FIG. 2, so that the shift pin 65*a* moves diagonally along the curved groove 64*c* as illustrated in a center of FIG. 7. That is, the shift pin 65*a* moves on the right side relative to the outer peripheral surface of the cam piece 60, and hereby, practically, the shift pin 65*a* presses the cam piece 60 toward the left side in a sliding manner.

When the cam piece 60 slides to the left side and the shift pin 65*a* reaches the right straight groove 64*b* as illustrated on a lower side in FIG. 7, the cam piece 60 is switched to a left low lift position. Here, the shift pin 65*a* is moved backward so as to be disengaged from the guide groove 64. At the low lift position, the low lift cam 62 is selected, so that the intake valve 10 is operated in the exhaust stroke via the arm assembly 50 and the rocker arm 15.

Note that a slide amount S (illustrated in FIG. 6) of the cam piece 60 that is changed from a normal position to the low lift position is the same as an interval between the general cam 61 and the low lift cam 62. Further, although not illustrated herein, in the present embodiment, a locking mechanism configured to maintain the cam piece 60 at the normal position or the low lift position is provided between the intake camshaft 12 and the sleeve 63. Further, a depth of the guide groove 64 is approximately 0 in the middle of each of the left and right straight grooves 64*a*, 64*b*, and when the shift pin 65*a* is moved backward here as described above, the shift pin 65*a* is smoothly disengaged from the guide groove 64.

Further, although detailed explanations are omitted, in a converse manner to the switching from the normal position to the low lift position, when the shift pin 65*a* of the actuator 65 is engaged with the guide groove 64 of the cam piece 60 placed at the low lift position, the cam piece 60 can be slid toward the right side so as to be returned to the normal position. That is, after the shift pin 65*a* is engaged with the right straight groove 64*b* of the guide groove 64 and the shift pin 65*a* reaches the left straight groove 64*a* along the curved groove 64*d*, the shift pin 65*a* is moved backward.

As a control device for controlling the actuator 65 as described above, an ECU of the engine 1 is used. The ECU controls the actuator 65 such that the ECU acquires positional information about the guide groove 64 based on signals input from a crank angle sensor of the engine 1, a cam angle sensor for detecting a position of the intake camshaft 12, and the like, and then determines a timing to engage the shift pin 65*a* with the guide groove 64 as described above.

Figure 8:
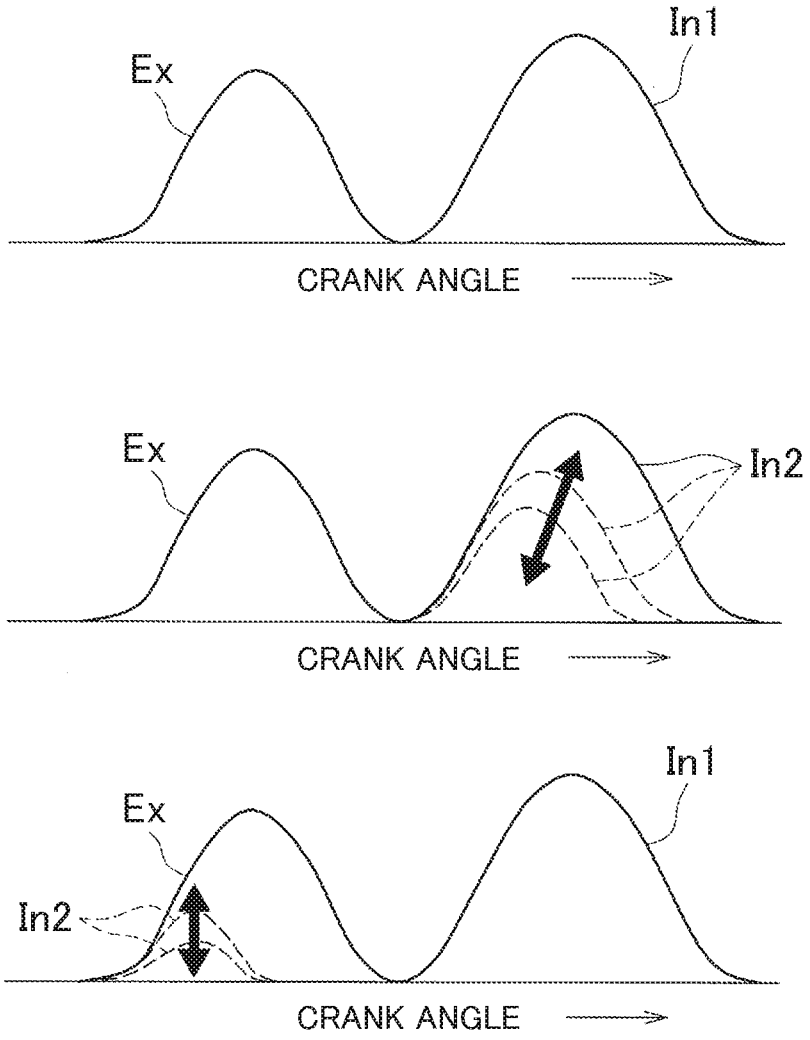
FIG. 8 is an explanatory view illustrating a change of a lift characteristic of an intake valve in the valve device of the embodiment.

Referring now to FIG. 8, the following describes an operation of the valve system that changes a lift characteristic of the intake valve 10 in each cylinder 3 by combining operations of the variable lift mechanism 4 and the cam switch mechanism 6 described above. In FIG. 8, a lift curve Ex indicated by a continuous line on the left side indicates a lift characteristic of the exhaust valve 11, and lift curves In1, In2 indicated by a continuous line or a broken line on the right side indicate lift characteristics of the intake valves 10 on the first side and the second side.

First, during an operation of the engine 1, the first swing arm 40 of the cylinder 3 is swung by the fixed cam 12*a* of the intake camshaft 12, so as to operate the intake valve 10 on the first side according to the profile of the fixed cam 12*a*. Hereby, the lift characteristic of the intake valve 10 on the first side exhibits a lift curve In1 illustrated on an upper side in FIG. 8, and does not change even if the variable lift mechanism 4 and the cam switch mechanism 6 operate.

On the other hand, the lift characteristic of the intake valve 10 on the second side in the cylinder 3 is changed by the operations of the variable lift mechanism 4 and the cam switch mechanism 6 as follows. That is, first, if the engine 1 is in a normal operation mode, the general cam 61 is selected by the cam switch mechanism 6, so that the intake valve 10 on the second side is operated by the general cam 61 rotating integrally with the intake camshaft 12, via the output arm 52 of the arm assembly 50 and the rocker arm 15.

At this time, the swing range of the output arm 52 is changed, so that the lift amount of the intake valve 10 on the second side changes continuously. That is, for example, in a case where the variable lift mechanism 4 is at the maximum lift amount with reference to FIG. 3, the lift characteristic of the intake valve 10 on the second side exhibits the lift curve In1 indicated by the continuous line on the upper side in FIG. 8, that is, the lift amount of the intake valve 10 on the second side is the same as that of the intake valve 10 on the first side. This is advantageous in terms of increasing intake-air charging efficiency of the cylinder 3, and is suitable at the time of a high-load operating state, warm restart of the engine 1, and the like, for example.

Further, the lift characteristic of the intake valve 10 on the second side continuously changes by the operation of the variable lift mechanism 4 from the state of the maximum lift amount to the state of the minimum lift amount with reference to FIG. 5, as indicated by the lift curves In2 of the continuous line and the broken line in a center of FIG. 8. Hereby, the lift amount of the intake valve 10 on the second side becomes smaller than that of the intake valve 10 on the first side. Accordingly, even in an operating state such as a low load in which a flow rate of the intake air is decreased, a flow speed of the intake air is raised to enhance a swirl flow in the cylinder 3, thereby making it possible to increase combustibility.

In a case where the engine 1 is in an operation mode different from the normal operation mode, e.g., an operation mode in which HCCI combustion is performed, and a temperature inside the cylinder is controlled by so-called internal EGR, the low lift cam 62 is selected by the cam switch mechanism 6 as a cam for driving the intake valve 10 on the second side in the cylinder 3. The low lift cam 62 rotates integrally with the intake camshaft 12, so as to open the intake valve 10 on the second side in the exhaust stroke of the cylinder 3 via the output arm 52 of the arm assembly 50 and the rocker arm 15.

Also in the operation mode different from the normal operation mode, the lift characteristic of the intake valve 10 on the first side in the cylinder 3 does not change as described above, and as illustrated as the lift curve In1 of the actual line on a lower side in FIG. 8, the intake valve 10 on the first side operates according to the profile of the fixed cam 12*a* similarly to the normal operation mode described above. Hereby, it is possible to obtain sufficient intake-air charging efficiency for an operation on a low-load low-rotation side on which the HCCI combustion can be performed.

The intake valve 10 on the second side in the cylinder 3 is opened from an early stage to a middle stage of the exhaust stroke as illustrated as the lift curve In2 of the broken line on the lower side in FIG. 8. Hereby, after exhaust gas in the cylinder 3 is partially exhausted to an intake port once, the exhaust gas flows into the cylinder 3 again in a next intake stroke. By blowing and returning part of the exhaust gas to an intake system as such, so-called internal EGR is performed, thereby making it possible to set the temperature in the cylinder to a temperature suitable for the HCCI combustion.

That is, the lift amount of the intake valve 10 on the second side thus opened in the exhaust stroke continuously changes by the operation of the variable lift mechanism 4 as illustrated as the lift curve In2 of the broken line on the lower side in FIG. 8. For example, if the lift amount is made small, an amount of internal EGR gas, that is, a ratio of the exhaust gas included in the intake air decreases, and if the lift amount is made large, the amount of the internal EGR gas increases. By adjusting the amount of the high-temperature internal EGR gas with accuracy as such, it is possible to control the temperature in the cylinder with high accuracy to a temperature suitable for the HCCI combustion.

As described above, in the engine 1 according to the present embodiment, the intake valve 10 on the first side out of two intake valves 10 provided for each cylinder 3 is driven by the fixed cam 12*a* of the intake camshaft 12 and is configured simply without a variable mechanism, while the intake valve 10 on the second side is configured such that its lift characteristic can be largely changed by the variable lift mechanism 4 and the cam switch mechanism 6 and the lift amount can be changed continuously.

Hereby, it is possible to switch between the normal operation mode by the spark ignition and an operation mode such as the HCCI combustion, which is different from the normal operation mode, and it is also possible to increase a response of the control on the lift amount of the intake valve 10 in both operation modes. This is because the arm assembly 50 of the variable lift mechanism 4 does not receive a reaction force of the valve spring 10*a* from the intake valve 10 on the first side and delay of the operation due to a mechanical frictional resistance decreases.

Particularly, in the operation mode different from the normal operation mode, a lift amount of the low lift cam 62 selected by the cam switch mechanism 6 is small, so the reaction force of the valve spring 10*a* from the intake valve 10 on the second side also becomes small by just that much, thereby resulting in that the mechanical frictional resistance is further decreased in combination with a narrow cam width of the low lift cam 62. This further decreases the delay of the operation of the arm assembly 50, thereby making it possible to obtain a high response requested to a control on the HCCI combustion.

In addition, in the present embodiment, as described above, the intake valve 10 on the first side in the cylinder 3 is driven by the fixed cam 12*a* without the variable lift mechanism 4 and the cam switch mechanism 6. Accordingly, even if either of the mechanisms is broken, that does not affect the operation of the intake valve 10 on the first side. That is a fail-safe with respect to a failure of the variable lift mechanism 4 or the cam switch mechanism 6 is achieved.

The embodiment is not limited to the abovementioned configuration at all. The embodiment is merely an example, and does not limit purposes and the like. For example, the configuration of the variable lift mechanism 4 in the embodiment is only one example, and the variable lift mechanism 4 may have other configurations, provided that the lift amount of the intake valve is continuously changed such that the swing range of the arm swinging along with the rotation of the camshaft is changed by a variable mechanism.

Further, the embodiment describes a structure (a rocker-arm type) in which the rocker arm 15 is operated by the swing arm 40 or the output arm 52 so as to operate the intake valve 10 via the rocker arm 15, but is not limited to this. For example, a so-called direct-acting structure in which a top portion of the intake valve 10 is pressed by the swing arm 40 or the output arm 52 may be employed.

Further, the cam switch mechanism 6 is also not limited to the one in the embodiment. For example, a well-known guide groove having various shapes may be provided on the outer periphery of the cam piece 60 provided around the intake camshaft 12, instead of the guide groove 64 like the one in the embodiment. The guide groove having various shapes includes a Y-shaped guide groove as described in JP 2009-052419 A. Further, the embodiment is not limited to the guide groove, and a guide portion having a shape that engages with the shift pin 65*a* to slide the cam piece 60 may be provided.

Further, in the embodiment, the general cam 61 and the low lift cam 62 are provided in the cam piece 60 and the cam width of the low lift cam 62 is narrower than the general cam 61. However, the embodiment is not limited to this, and the cam width of the low lift cam 62 may be the same as the general cam 61. Further, the embodiment is also not limited to the low lift cam 62, and a cam having a different working angle from the general cam 61, but having the same lift amount as the general cam 61, or a cam with a zero lift may be provided.

Further in the embodiment, the low lift cam 62 is provided so as to open the intake valve 10 in the exhaust stroke of the cylinder 3. However, the embodiment is not limited to this, and the low lift cam 62 may be provided so as to open the intake valve 10 from the exhaust stroke to the intake stroke, for example, or the low lift cam 62 may be provided so as to open the intake valve 10 in a period largely different from the general cam 61 in the intake stroke. Further, the general cam 61 is not necessary to have the same profile same as the fixed cam 12*a* like the embodiment.

Further, the embodiment deals with a case where the valve device of the present disclosure is applied to the series three-cylinder gasoline engine 1, as an example. However, the embodiment is not limited to this, and the present disclosure is also applicable to a series four-cylinder or five or more cylinder gasoline engine. Further, the embodiment is also not limited to the gasoline engine, and the present disclosure is also applicable to an engine using alcohol fuel.

According to the valve device, in a case where a lift variable mechanism that can continuously change a lift amount of an intake valve is provided in a valve system of an engine, it is possible to switch between a normal combustion state and a different combustion state and to increase a response of a control. Accordingly, the present disclosure can yield a high effect when it is applied to an engine that performs HCCI combustion, and the like.

What is claimed is:

1. A valve device for an internal combustion engine, the valve device comprising:

two intake valves provided for each cylinder of the internal combustion engine, the two intake valves including a first intake valve and a second intake valve;

a camshaft;

a first swing arm configured to swing along with a rotation of the camshaft, the first swing arm being configured to operate the first intake valve;

a second swing arm configured to swing along with the rotation of the camshaft, the second swing arm being configured to operate the second intake valve;

a cam piece provided around the camshaft;

a first cam fixed to the camshaft, the first cam being configured to swing the first swing arm such that the first intake valve is operated according to a profile of the first cam;

second cams provided on the camshaft, the second cams being configured to swing the second swing arm, the second cams including a plurality of cams having different profiles, the plurality of cams being provided on the cam piece so as to be arranged in an axial direction of the camshaft, one of the plurality of cams being configured to be selected by sliding the cam piece; and a variable mechanism configured to change a swing range of the second swing arm such that a lift amount of the second intake valve changes continuously.

2. The valve device according to claim 1, wherein the second cams include a general cam and a low lift cam, the general cam has the profile as the first cam, and the low lift cam has a lift amount smaller than a lift amount of the general cam.

3. The valve device according to claim 2, wherein the low lift cam is configured such that the second intake valve is opened in an exhaust stroke of the cylinder.

4. The valve device according to claim 2, wherein a dimension of the low lift cam in the axial direction of the camshaft is smaller than a dimension of the general cam.

5. The valve device according to claim 1, wherein:

the variable mechanism is provided adjacently to the first swing arm;

the variable mechanism is configured to swing around a spindle of the variable mechanism;

the variable mechanism includes an input arm, a movable connecting member and an adjustment member;

the second cams are configured to press the input arm;

the movable connecting member is configured to connect the input arm to the second swing arm such that a relative angle between the input arm and the second swing arm is changed; and the adjustment member is configured to operate the movable connecting member so as to adjust the relative angle between the input arm and the second swing arm.

* * * * *